United States Patent [19]

Strozzi

[11] 4,067,476

[45] Jan. 10, 1978

[54] AUTOMATIC SEALING DEVICE FOR CONTAINERS OF VOLATILE OR PERISHABLE LIQUIDS

[76] Inventor: Luigi Strozzi, Via Emiliana Piacentina n° 40, Castel S. Giovanni-Piacenza, Italy, 29015

[21] Appl. No.: 755,415

[22] Filed: Dec. 29, 1976

[30] Foreign Application Priority Data

| | | |
|---|---|---|
| Jan. 9, 1976 | Italy | 19120/76 |
| Oct. 14, 1976 | Italy | 28298/76 |

[51] Int. Cl.[2] ..... B65D 87/18; B65D 87/20

[52] U.S. Cl. ..... 220/224; 220/227; 220/216

[58] Field of Search ..... 220/93, 216, 221, 224, 220/227, 334

[56] References Cited

U.S. PATENT DOCUMENTS

| | | | |
|---|---|---|---|
| 3,800,975 | 4/1974 | Nishkian et al. | 220/224 |
| 3,915,332 | 10/1975 | Pladys | 220/224 |

*Primary Examiner*—George T. Hall

*Attorney, Agent, or Firm*—Beveridge, De Grandi, Kline & Lunsford

[57] ABSTRACT

An automatic sealing device for containers for volatile or perishable liquids. The sealing device includes a substantially cylindrical chamber having a flexible side wall to make a sealing engagement with the container wall. The flexible side wall is secured to upper and lower circular closing members through a series of links which perform the two functions of causing the device to follow variations in the level of the liquid and hold the flexible side wall against the container wall.

12 Claims, 7 Drawing Figures

AUTOMATIC SEALING DEVICE FOR CONTAINERS OF VOLATILE OR PERISHABLE LIQUIDS

This invention relates to an automatic device for sealing of containers of volatile or perishable liquids, such as wine.

In containers, such as barrels, having generally a cylindrical shape, intended to contain volatile or perishable liquids, there is the need for a sealing closure to prevent the atmospheric air to penetrate the container, which closure can follow the level variations of the liquid in order to avoid forming of an air gap which would deteriorate the liquid.

A number of devices aiming to solve this problem has been produced, but mainly such devices were inaccurate pieces of handicraft, based on the principle according to which an appropriately inflated air tube forms a sealing member on the container side wall. However it will be evident that such attempts do not assure a perfect seal, especially in the long run.

This invention overcomes these drawbacks and provides an automatic sealing device for such containers, having a full mechanical operation without making use of springs, and accordingly it is reliable, rugged and makes a perfect, unalterable seal.

The automatic sealing device for containers of the invention consist substantially in a cylindrical chamber, having a flexible side wall in order to make a seal on the container wall, which is secured to an upper closing member and a lower closing member, respectively, by a plurality of square shaped links which act both to cause the device to follow the level variations of the liquid and keeping the flexible side wall pressed against the container wall.

Accordingly, in a first embodiment the plurality of links are secured to further intermediate members which, in turn, are pivotally connected to the two closing members or covers of the device; according to another embodiment, with a somewhat modified construction, the links can be directly secured to the closing members or covers, thus substantially simplifying the construction and assembly thereof, reducing the number of the required parts and, therefore, the production costs.

Moreover, it can be seen that this automatic device can be applied, with identical success, also to containers having quadrangular or polygonal cross-section, instead of circular, making use of the same structural principles and linking systems.

The features and advantages of the device of the invention will be pointed out as the detailed description proceeds of some preferred embodiments thereof, given to illustrative and not restrictive purposes only, taken together with the annexed drawings, wherein.

Figure 1:
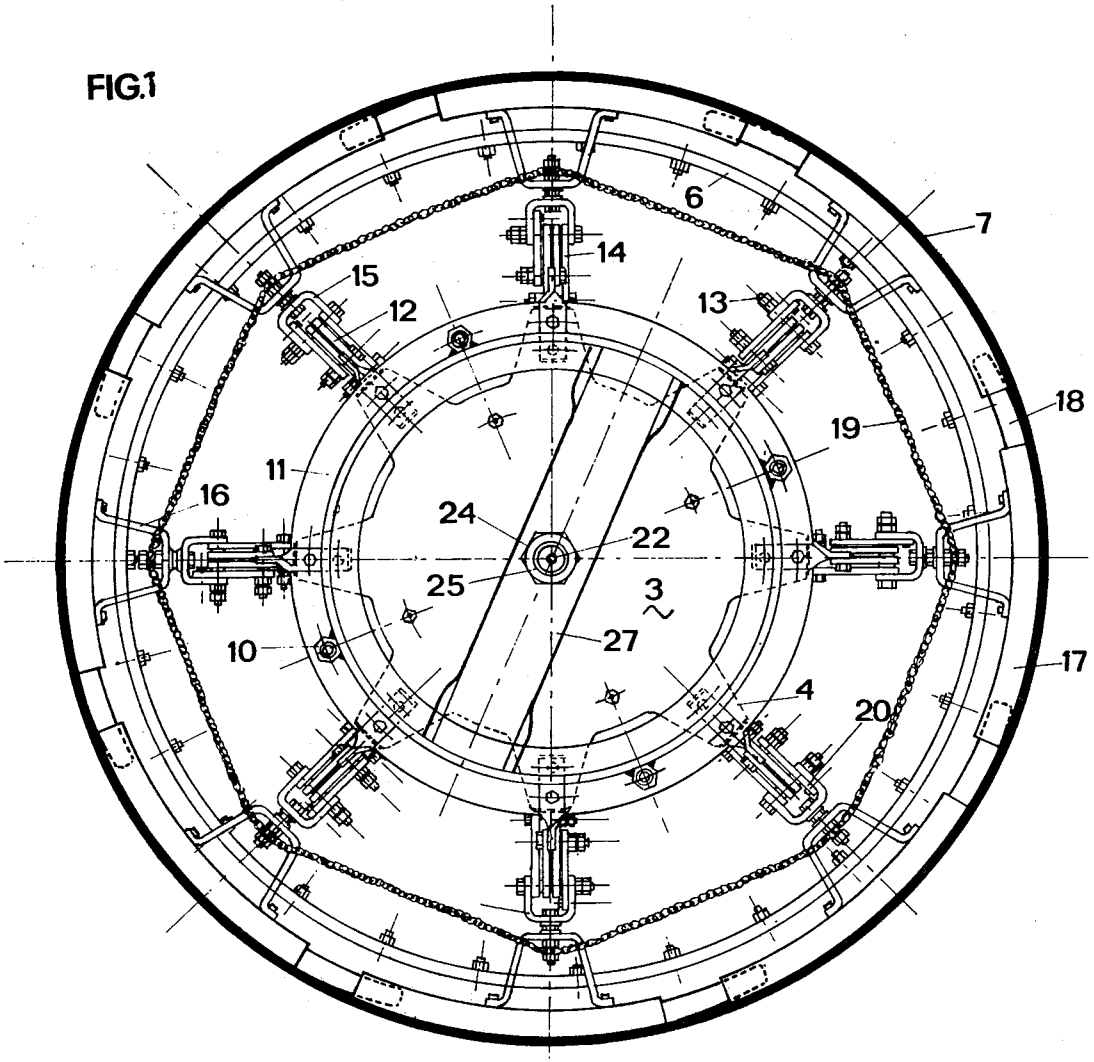
FIG. 1 is a top plan view of a first embodiment of the device with the covering element omitted to show the inner members thereof.
Figure 2:
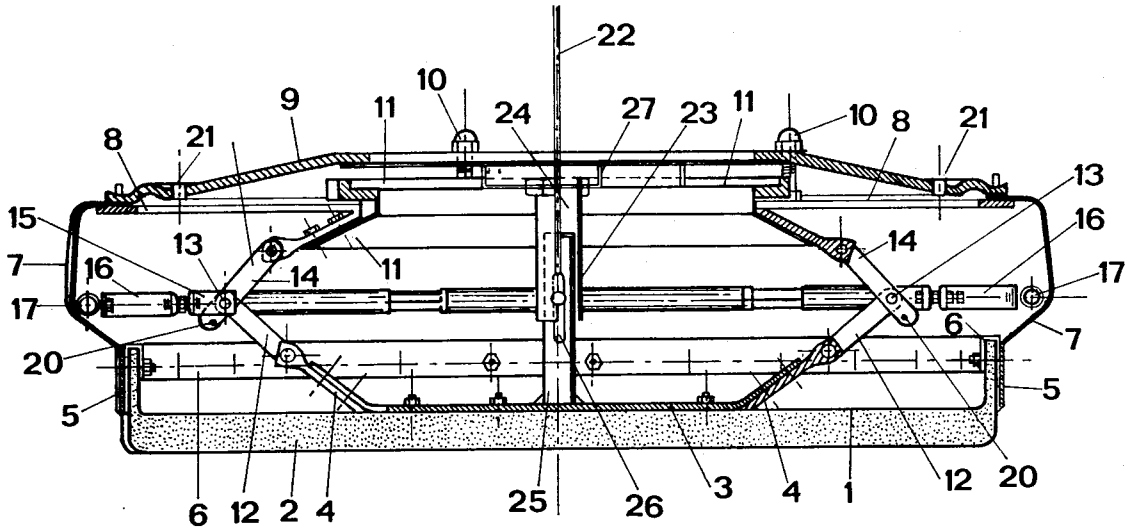
FIG. 2 is a sectional elevation.

Referring now to FIGS. 1 and 2 of the annexed drawings, the automatic sealing device according to the invention comprises a bottom member, consisting of one or more layers of material. The bottom member could also consist of simple metallic disk 1, but to prevent contamination of the liquid of the container (not shown) it is preferred to coat metallic disk 1 with a layer 2 of an unharmful material to the liquid contained therein (not shown) which would also act for lightening the unit, as wood, cork, plastics and rubber.

A shaped plate 3 provided with sloping protrusions or brackets 4, is mounted on metallic disk 1, inside the device, and the upright edge 5 thereof cooperates with an annular band 6 to clamp the lower edge of a flexible gasket 7 forming the device side wall, which is made of rubber or the like, adapted to create a seal on the container side wall.

The upper edge of tubolar flexible band 7 is secured to an annular flat plate 8 which is also a support for upper member or cover 9, which is fastened to an annular support below 11, by bolts 10.

Thus a closed cylindrical chamber having a variable volume is created which acts also as an insulating space for the liquid of the container, that is therefore more protected from changes of temperature.

The lower arms 12 of bell-crank levers centrally pivoted on a central pin 13 are pivotally connected to bottom brackets 4, and the upper arms 14 thereof are in turn pivotally connected to annular support 11.A U-member 15 is secured to each pin 13 and the base thereof is secured to a bracket 16 supporting an arcuate tubolar element 17, having an extension 18 of a lesser diameter fitting in next arcuate element 17.

Thus, arcuate elements 17 all together form a telescopic tubolar ring that stretches flexible gasket 7, yet being able of extending and contracting to follow any level variations. It is preferable to restrain the telescopie ring of elements 17, 18 from overextending in order to avoid overstressing of flexible gasket 7.

A number of chains 19 is provided to this aim which strain upon extension of the telescopie ring thus avoiding overextension thereof beyond a selected limit. Conversely, at least one branch of the lever arms (referred to by reference 20 in the figures) is of more length to provide a limit stop for the link swinging in the opposite direction, in order to prevent the telescopic ring from contracting in excess, which could cause the pivoted bell-crank levers to overturn.

Figure 3:
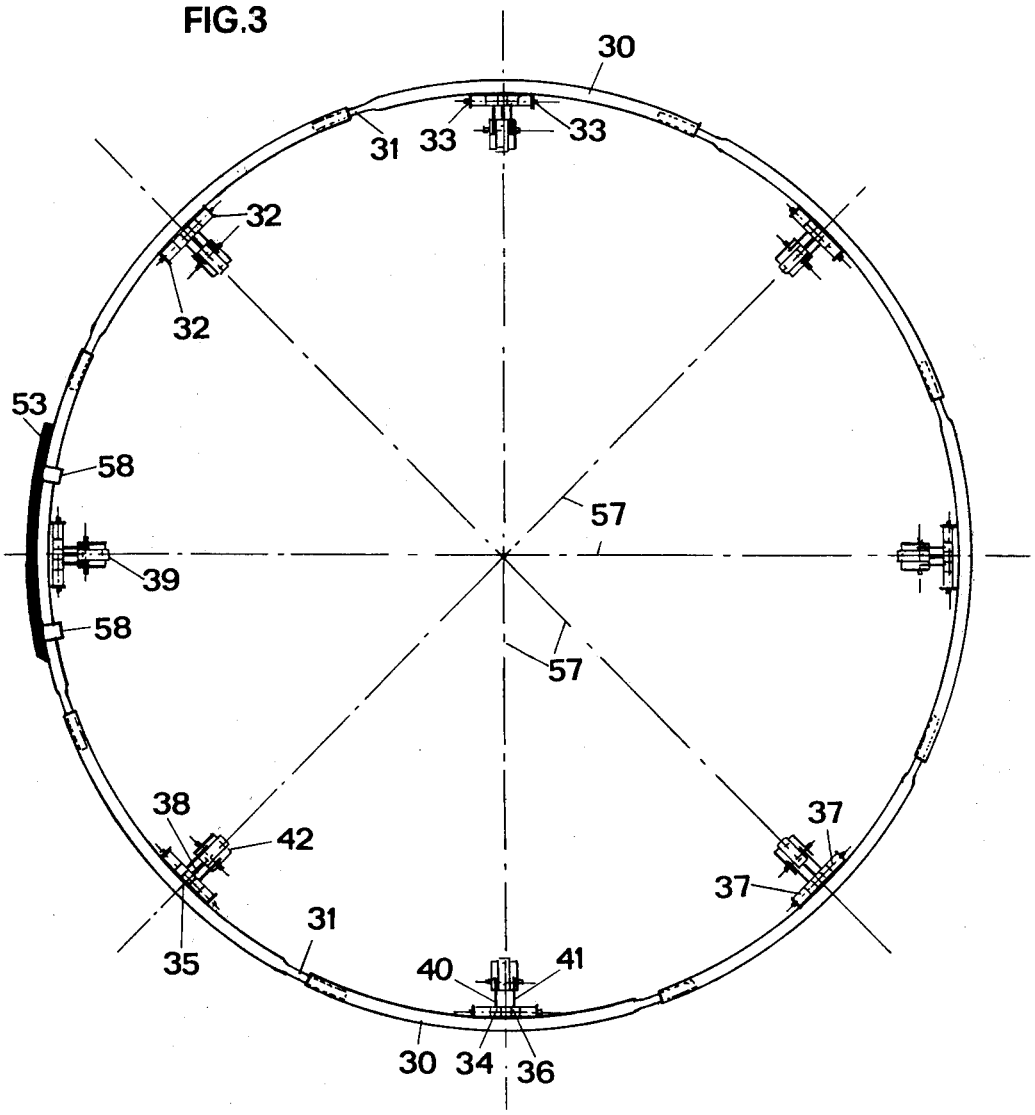
FIG. 3 is a top plan view of a device, of the simplified, circular type.
Figure 5:
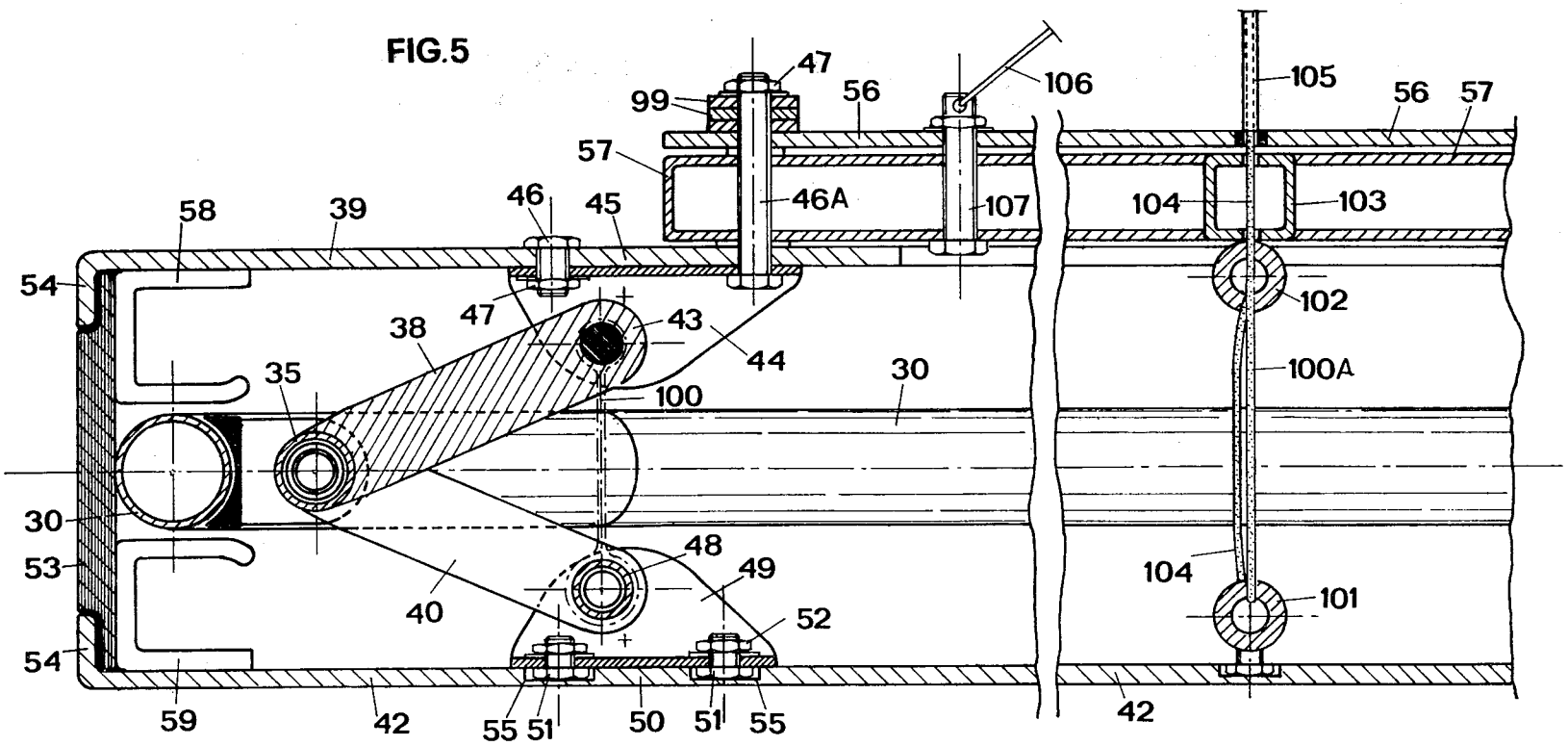
FIG. 5 is a sectional elevation, greatly enlarged, of a link system of the circular-type device of FIG. 3, wherein also the covers are visible with the securing means thereof and the lifting members for the whole device.

Referring now first to FIGS. 3 and 5, an improved and simplified cylindrical device will be described, wherein the links are secured directly to the covers.

In this embodiment, the telescopic ring forcing the flexible side wall against the container wall is still formed by arcuate tubolar members 30, which are fully or partially hollow, to receive extension 31 of a lesser diameter of the adjacent arcuate element. A couple of tongues 32 are secured, preferably by welding, to the middle of each arcuate tubolar element 30, which tongues mount a pin 33 receiving three bushes 34, 35, 36, fitted thereon and maintained in a central position by two hollow tubolar side spacers 37, also fitted on pin 33.

Central bush 35 is linked to upper cover 38 through a link 38, and side bushes 34 and 36 are linked to lower cover 42, through links 40 and 41, respectively.

More particularly, link 38 is pivoted, through pin 43, to flanges 44 of a plate 45, secured to upper cover 39 by bolts 46 and nuts 47. Likewise, links 40 and 41 are both pivoted, through pin 48, to flanges 49 of a plate 50 secured to lower cover 42, as by bolts 51 and nuts 52, which bolts are received in cavities 55 produced on lower cover 42, so that they do not protrude therefrom, preventing any contaminations of the liquid in the container.

As in the preceding embodiments, upper cover 39 and lower cover 42 are connected also by the flexible side wall of the device, sealingly engaged with the container wall, which consist of cylindrical gasket 53, secured to edges 54 of these covers, such as by an adhesive, and made of rubber or other natural or syntetic material having appropriate resilience and strength.

Both upper cover 39 and lower cover 42 are provided with inner lower and upper guides, 58 and 59, respectively, in correspondence to each arcuate tubolar element 30, which guides act to hold elements 30 in the center of flexible wall 53, while the device is moving. The inner guides operate also for backing flexible wall 53, also through a supporting annular band or flexible continuous ring.

Upper cover 39 is actually a flat annular plate having a central opening covered by a detachable and removable central covering member 56, to permit access to the device interior, as described in connection with the first embodiment.

Central covering member 56 is supported by a number of stiffening sections 57, arranged as a bracing cross, that can be four in number (as shown in FIG. 5) or eight (as diagrammaticaly shown in FIG. 3). Sections 57 and central member 56 are both secured to upper cover 39, through extended bolt 46A, fixing also plate 45 to cover 39.

Moreover, bolt 46A is of such a length as to form a receiving seat, externally of covering member 56, for ballast members, such as metallic disks 99, fitted over bolt 46A, in a number related to the specific gravity of the liquid inside the container, and held in place by a further nut 47. Upper cover 39, appropriately ballasted, exerts a downwards directed force producing a more effective seal to the container wall.

The number of links, as well as the two covers, are internally connected by flexible but not extendible cables 100 defining the maximum distance the two covers can move away from each other. Central flexible cable 100A is anchored to a couple of eye hooks, the lower one 101 being fastened to lower cover 42 an the upper one 102, being fastened to a central box 103, to which box sections 57 connect, serving as a passage for a flexible wire 104 of the type utilized in bycicle brakes. Wire 104 acts as a control member for forcing covers 39 and 42 towards each other in order to produce a strong seal against the container wall. Where it is not possible or desired the use of ballast, such as where the liquid inside the container is of low specific gravity and therefore a ballasted cover would sink. Wire 104 comes out of the sheath 105, which ends at central member 56, crosses box 103 and reaches lower hook 101. Thus, it will be evident that, by pulling the opposite end of wire 104, covers 39, 42 will be caused to come closer to each other.

Finally, four cables 106, forming a "sling", as used in fishing nets, anchored to bolts 107, in turn fastened to section 57 as closest possible to the outer ends thereof, are provided to evenly lift the whole device.

Figure 4:
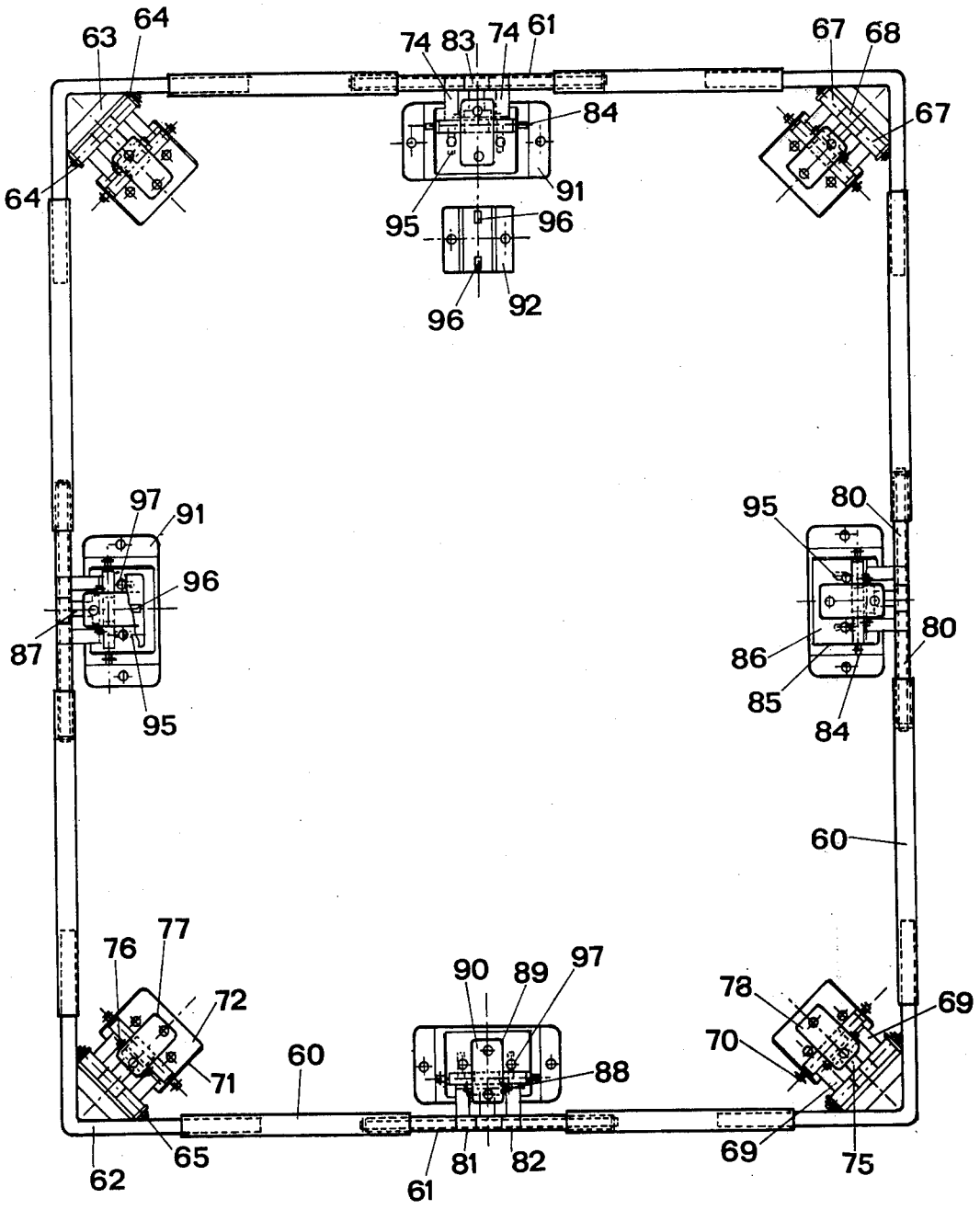
FIG. 4 is a similar top plan view of a device, of the quadrangular type.
Figure 6:
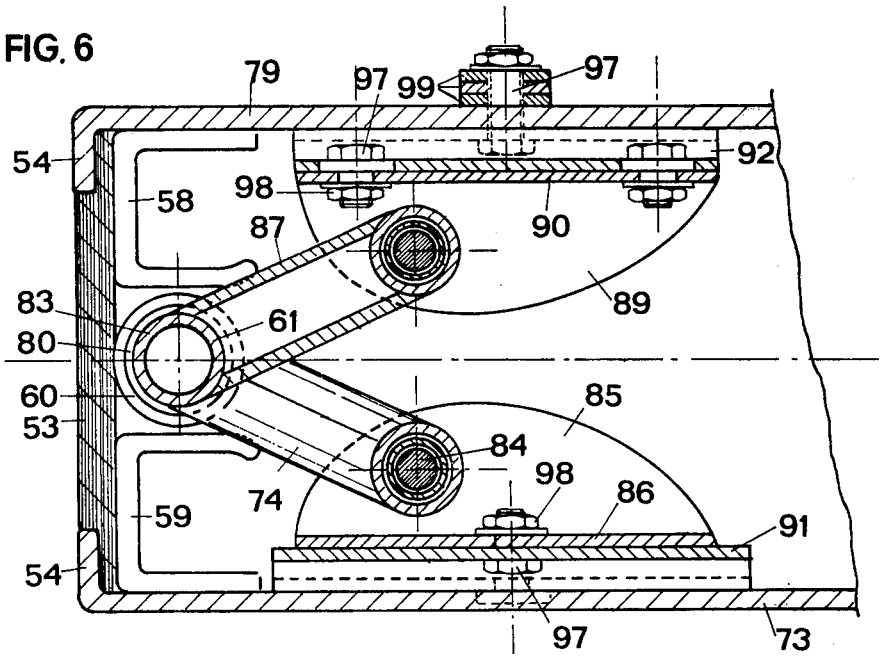
FIG. 6 is a similar sectional elevation, greatly enlarged, showing only an articulated link of the quadrangular-type device of FIG. 4.

Referring now to FIGS. 4 and 6, a construction for quadrangular containers is illustrated, where the word quadrangular is referred both to rectangular cross-section containers, as shown in the drawing, and the square cross-section container, though the basic principles of this embodiment can obviously be applied to any polygonal shapes, the triangular shape being included.

In this embodiment, quadrangular structure pressing the gasket against the container wall is formed of fully or partially tubolar lengths 60, which are the sides thereof, and straight telescopic members 61 as well as angled telescopic members 62, which allow the structure to extend and support the linking units secured to covers 31, 42.

Turning now to illustrate in details first telescopic angled members 62, having the ends slidingly fitting in adjacent straight members 60, it will be seen that angled members 62 have a strengthening bar 63, diagonally arranged, a pin 65 being secured thereto by tongues 64.

Two side bushes 66 and 67, and one central bush 68 are fitted on pin 65.

Side bushes 66 and 67 are pivotally connected, through links 69, to a pin 70 fastened to flanges 71 of a plate 72 directly secured to lower cover 73 and central bush 68 is pivotally connected, through a link 75, to a pin 76 fastened to tongues 77 of a plate 78 directly secured to upper cover 79. Thus a pivoting connection is made between angled telescopic members 62 and the covers.

Likewise, straight telescopic members 61 are each in the form of a rod telescopically sliding in the adjacent straight lengths 60. Two side bushes 81 and 82 and a central bush 83 are fitted on rod 61 and the three bushes are held in a central position by two side spacers 80, likewise fitted on rod 61. Here again, side bushes 81 and 82 are pivotally connected, through links 74, to a pin 84 fastened to flanges 85 of a lower plate 86 and central bush 83 is pivotally connected, through link 87, to a pin 88 fastened to flanges 89 of an upper plate 90, thus a pivoting connection between straight telescopic members 61 and the covers is obtained.

However, it must be pointed out that the stroke or movement of angled telescopic members 62 is shorter than straight telescopic members 61, during the lowering and lifting movements of the device, and therefore straight telescopic members 61 must be connected to the covers through the intermediate of distance adjusters which are adjusted for the exact stroke length, upon fastening of the covers.

To this purpose, upper and lower plates 86 and 90, respectively, are secured rather to upper and lower spacing counter-plates 91 and 92, respectively, than to the corresponding covers, directly. Counterplates 91 and 92 are in turn secured to upper and lower covers 73 and 79, respectively, by adjusting the position of plates 86 and 90 on counterplates 91 and 92, making use of slits 95 and 96 and locking bolt-and-nut units 97, 98.

Also in this embodiment, bolts 97 of lower cover 73 do not protrude externally, while bolt 97A of upper cover 79 has an exention to receive ballast disks 99 already mentioned above.

Figure 7:
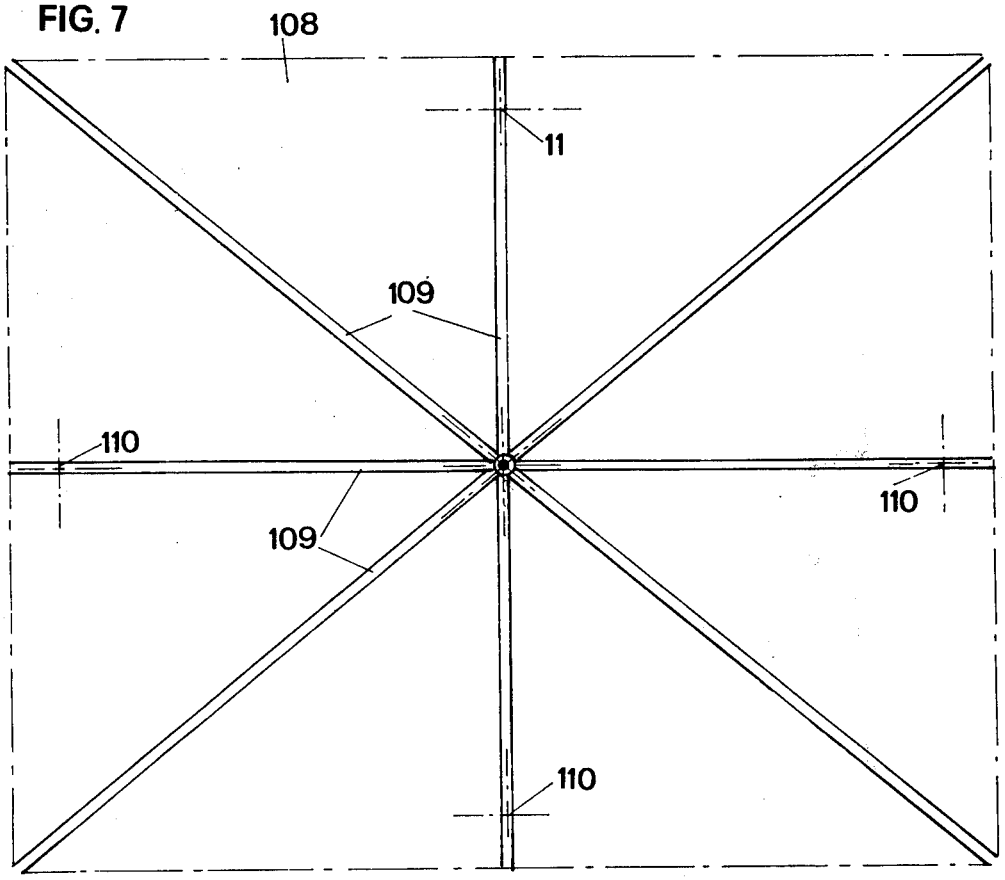
FIG. 7 is a diagrammatic plan view of the stiffening elements of the upper cover of a quadrangular type device.

Also in this embodiment, upper cover 79 actually consist of a centrally open end peripheral band covered, in turn, by a central closing member 108, diagramatically shown in FIG. 7.

Central closing member 108, similarly to circular member 56 shown in FIG. 5, is strengthened and stiffened by means of sections 109, that can be four or eight in number, as shown.

In connection with central covering member 108, the same members are provided as above described with reference to FIG. 5, namely the wire for pulling the covers closer to each other, flexible cables for limiting the distance therebetween and the cables for lifting the whole device, the anchoring points thereof being shown at 110 in the figure.

In the operation, once the container has been filled up with the liquid, the device of the invention will seal the container as the liquid, forcing upwards the bottom thereof, will cause the square shaped link levers to get closer and consequently the extension of the telescopic circular ring, thereby gasket 7 will be forced to sealing engage the container wall.

Upon drawing of some liquid from the container, the device bottom will lower causing the square shaped link levers to spread out and consequently a contraction of the circular telescopic ring; therefore seal 7 will not adhere any longer to the container wall. However the device upper part, or cover, will immediately lower by gravity causing again square shaped levers to get closer thus the extension of the telescopic ring will take place and accordingly, a sealing engagement of flexible gasket 7 with the container wall.

Vents 21 are provided on cover 9, having valves (not shown) to maintain an uniform air pressure in the device interior. Preferably there will be four valves, simmetrically arranged, namely a couple of charging valves and a couple of discharging valves.

A cable 22 operable through a crank, or the like, arranged on the device (not shown) is provided in order to lift again the device of the invention, once the container has been emptied, or to take the device in floating condition on the liquid. Cable 22 is anchored to a peg 23 transversally arranged on a tube 24 fitting over a smaller tube 25, secured to the device bottom and provided with a slit 26 for the sliding movement of peg 23. Tube 24 is secured to a cross piece 27 located below cover 9, that, therefore, can be removed independently for maintenance and/or cleaning of the device chamber. To this purpose, the cover will be provided with a grip or handle (not shown) intended to allow the cover to be safely handled and removed independently of the device.

Also in the simplified embodiments illustrated in FIGS. 3, 4, 5, 6, 7, the two covers move closer to each other when the lower cover is forced upward by the liquid inside the container and consequently the link units, getting closer to each other, cause the telescopic structure to extend, forcing the gasket against the container wall for a sealing engagement therewith.

Conversely, a lowering of the liquid level will cause lower cover to lower and the link units to spread out; therefore the telescopic structure will contract and the gasket will disenagage from the container wall. The inherent lowering of the device will immediately create again the sealing engagement of the gasket, owing to the upper cover that will lower by gravity, causing again the link units to get closer with the consequent extension of the telescopic structure. Of course the size and construction details of the parts here described and illustrated can be modified, and said parts can be made of any convenient material, either metal, or plastic, such as fiberglass reinforced plastic.

From the foregoing it will be evident that a practical, simple and sturdy device has been illustrated; able to effect a perfect seal of a container, by automatically following the level variations of the liquid inside the container.

However it will be understood that various changements, modifications, additions and/or replacements of parts can be effected to the device structure, without departing neither from the scope nor from the conception thereof.

I claim:

1. Automatic sealing device for containers intended to contain volatile or perishable liquids, characterized in that said device comprises substantially a cylindrical chamber having a flexible side wall to make a sealing engagement with the container wall, and said flexible side wall is secured to upper and lower circular closing members through a series of square-shaped links performing the double function of causing said device to follow the level variations of the liquid and holding said flexible side wall forced against said container wall.

2. Device according to claim 1, characterized in that said square-shaped links consist each of a couple of upper arms pivotally connected to an annular support rigidly connected to said closing member and a couple of lower arms pivotally connected to brackets protruding from the bottom inner side, at the pivoting point of the two couples of arms being connected also a U member, in turn secured to a bracket supporting an arcuate tubular member, said arcuate tubular member having a length slidingly fitted in the adjacent arcuate tubular member, the series of said arcuate tubular members forming a telescopic ring holding the flexible gasket, which is said side wall of the device, in sealing engagement with the container wall.

3. Device according to claim 2, characterized in that the extension of said telescopic ring is restrained by chains connecting said square-shaped links and contraction is restrained by an extending length of at least one of said arms of said square-shaped links, in order to act as an inner limit stop of the link movement.

4. Device according to claim 1, characterized in that it is provided with a cable for lifting of the device itself and the cover from the upper body of the device, and that said cable is anchored to a peg forming part of a cylinder secured to a crosspiece arranged under said cover and fitted in a tube, having a slit for a sliding movement of said peg, secured to the device bottom.

5. Device according to claim 1, characterized in that there are air charging and discharging valves inside the cylindrical chamber, preferably arranged symmetrically on said cover.

6. Device according to claim 1, characterized in that, the lower closure member, or bottom, is coated with an external layer of a material consistent with the liquid inside said container.

7. Automatic sealing device for containers intended to contain volatile or perishable liquids according to claim 1, characterized in that said links moving the telescopic structure, which forces said gasket, are connected on one hand to the device covers directly and on the other hand to the arcuate telescopic members forming the structure, and fastening thereof to said arcuate telescopic members is obtained through bushes fitted, in a central position held by side spacers, over a pin secured to said telescopic members, the movement of which is guided by inner guiding members arranged on couples, each couple consisting of a member secured to said upper cover and an opposite member secured to said lower cover.

8. Device according to claim 1, characterized in that at least some of the bolts fastening said links to the upper cover have extensions to receive ballast members increasing the weight and pressure of said upper cover, thus increasing the sealing effect of the device against the container wall.

9. Automatic sealing device for containers intended to contain volatile or perishable liquids according to claim 1, characterized in that said forcing telescopic structure for a quadrangular or polygonal-cross section container consists of telescopic lengths, of straight and angled type, allowing said structure to extend and mounting the linking units secured to said two covers, and that each angular link is connected on one hand directly to the correspondig angled telescopic member by a transversal pin, and on the other hand to said cover direct by plates, and each side link is connected on one hand by direct fitting over the corresponding straight telescopic member and on the other hand to the covers through interposed spacing plates, on which the link plates are secured for adjusting the position thereof.

10. Device according to claim 1, characterized in that said upper cover consists of a peripheral element, to which said links are connected, and a removable central element to get access to the device interior.

11. Device according to claim 1, characterized in that said link plates and the cover centers are connected by flexible but unextendible cables limiting the movement away of the covers and that said covers can be moved toward each other by a flexible cable, anchored to the lower cover and operable from the outside.

12. Device according to claim 1, characterized in that the whole device is lifted by a sling consisting of cables anchored to the upper cover at selected positions allowing the balance of the weight thereof, said selected positions being located on stiffening sections or ribs arranged as a bracing cross and secured by the same fastening bolts of the links, receiving said ballast elements.

* * * * *